US007494294B1

(12) United States Patent
Kuo

(10) Patent No.: US 7,494,294 B1
(45) Date of Patent: Feb. 24, 2009

(54) PEN WITH DUAL EXTENSION/RETRACTION CARTRIDGES

(76) Inventor: Chun-Lia Kuo, 3F. No. 856, Sec. 5, Jhongshan N. Rd., Taipei City (TW)

( * ) Notice: Subject to any disclaimer, the term of this patent is extended or adjusted under 35 U.S.C. 154(b) by 0 days.

(21) Appl. No.: 12/020,557

(22) Filed: Jan. 27, 2008

(51) Int. Cl.
*B43K 27/08* (2006.01)

(52) U.S. Cl. ..... 401/29; 401/34

(58) Field of Classification Search ..... 401/29–33, 401/104–106, 117, 34
See application file for complete search history.

(56) References Cited

U.S. PATENT DOCUMENTS 3,288,116 A * 11/1966 Poritz ..... 401/29
3,985,455 A * 10/1976 Wahlberg ..... 401/30
4,000,950 A * 1/1977 Wahlberg ..... 401/32

* cited by examiner

*Primary Examiner*—David J Walczak

(57) ABSTRACT

A pen with dual extension/retraction cartridges includes two pen tubes where each of a first pen tube and a second pen tube has a pen tip portion and a pen end portion and a writing insertion plate disposed inside the pen tube near the pen tip portion; and a guiding tube disposed at the pen end portion of the first pen tube having an elastic plate disposed at one side and a positioning fastener disposed at one side of the elastic plate and two positioning rings disposed at the peripheral of the guiding tube, and a guiding slot disposed at the pen end portion of the second pen tube where the guiding slot is provided with a positioning hole passing through one side and a fastener disposed around the peripheral of the guiding slot so that the first pen tube and the second pen tube are combined with the guiding tube and guiding slot respectively; and at least two cartridges inserted onto the writing insertion plates of the first pen tube and the second pen tube respectively.

9 Claims, 17 Drawing Sheets

PEN WITH DUAL EXTENSION/RETRACTION CARTRIDGES

FIELD OF THE INVENTION

The present invention relates to a pen with dual extension/retraction cartridges, particularly to a pen structure with dual cartridges which it is simple in structure, easy made, aesthetic designed, easy manipulated, low cost, convenient and prevalent.

DESCRIPTION OF THE PRIOR ART

Since the first pen has been developed by human kind, there have been used writing brush, quill, charcoal pencil, pencil, pen, ball point pen and etc. Although various kinds of pens are developed to provide a better writing tool for people, there is nothing different in essential. In order to match the need of user, conventional pen is still kept improving in structure. For example to carry conveniently, conventional pen is covered with a pen cap at the writing end of the cartridge. Also, to prevent the pen cap from getting loose, there is an idea of hiding the cartridge inside the pen tube and pressing it out while in use so as to diminish the disposition of the pen cap. As a result it has to install with a structure of pressing and extending a cartridge or extending a cartridge in rotation inside the pen tube.

However, the abovementioned cartridge extension/retraction structure has to alter the original design of pen structure and needs more components. The more component not only increases the production cost but also causes difficulty for maintenance and makes conventional pen with extension/retraction cartridge liable to be damaged. Additionally, the pressing and extending type cartridge or rotating and extending type cartridge both increase the possibilities of wearing and tearing of pen tube. Especially in a limit space of pen tube a minor wearing and tearing may damage the precision of the pen tube and make the pen liable to break down or to be damaged.

Furthermore, for the convenience of operation a conventional pen has a design of dual color cartridges. However, in operation merely a single color cartridge is extended for writing at the one time by the way of pressing and switching. If necessary it is pressed again to switch another color of cartridge for writing. The main drawback of such a design is to go with the action of switching cartridge when the color of cartridge needs to be changed each time. It is not only troublesome but also the structure of such pen becomes very complicated so that it is liable to break down or to be damaged. Also too many components increase the space of pen tube so that the pen tube becomes thick and not easy for use.

To sum up, the abovementioned conventional design still has many drawbacks not to be a good design and needs to be improved.

SUMMARY OF THE INVENTION

The objective of the present invention is to provide a pen with dual extension/retraction cartridges. which is simple in structure for merely having two units, ready for use in cooperation with the standard cartridge in market and the production cost is low and beneficial to the promotion of product.

Another objective of the present invention is to provide a pen with dual extension/retraction cartridges, which is simple in manipulation. A user merely holds by one hand to manipulate the extension/retraction of cartridge. Comparing with the existing pen with pressing and extending type or rotating and extending type cartridge it is more convenient in use.

Yet another objective of the present invention is to provide a pen with dual extension/retraction cartridges, which is stable in structure, not liable to damage, smooth in holding, clockwise/counterclockwise rotated to replace cartridge, and convenient for the demand of user.

The next objective of the present invention is to provide a pen with dual extension/retraction cartridges, which it aesthetic and functional in design. Comparing the existing pen with dual cartridges it is smaller in volume, slender in pen tube, conforms to the general habit of using and beneficial to insert into the pocket of clothing for carrying.

A pen with dual extension/retraction cartridges achieving the abovementioned objectives comprises two cartridges where a first cartridge and a second cartridge both have a pen tip portion and a pen end portion and a writing insertion plate disposed inside the pen tube near the pen tip portion; the first pen tube being disposed with a guiding tube at the pen end portion which the guiding tube is disposed with an elastic plate having a positioning fastener disposed at one end and two positioning rings at the peripheral, and the second pen tube being disposed with a guiding slot at the pen end portion where the guiding slot is inserted with a positioning hole at one side and a fastener at the peripheral so that the first pen tube and the second pen tube are combined with the guiding tube and guiding slot respectively; and at least two cartridges being inserted into the writing insertion plate of the first pen tube and the second pen tube respectively.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
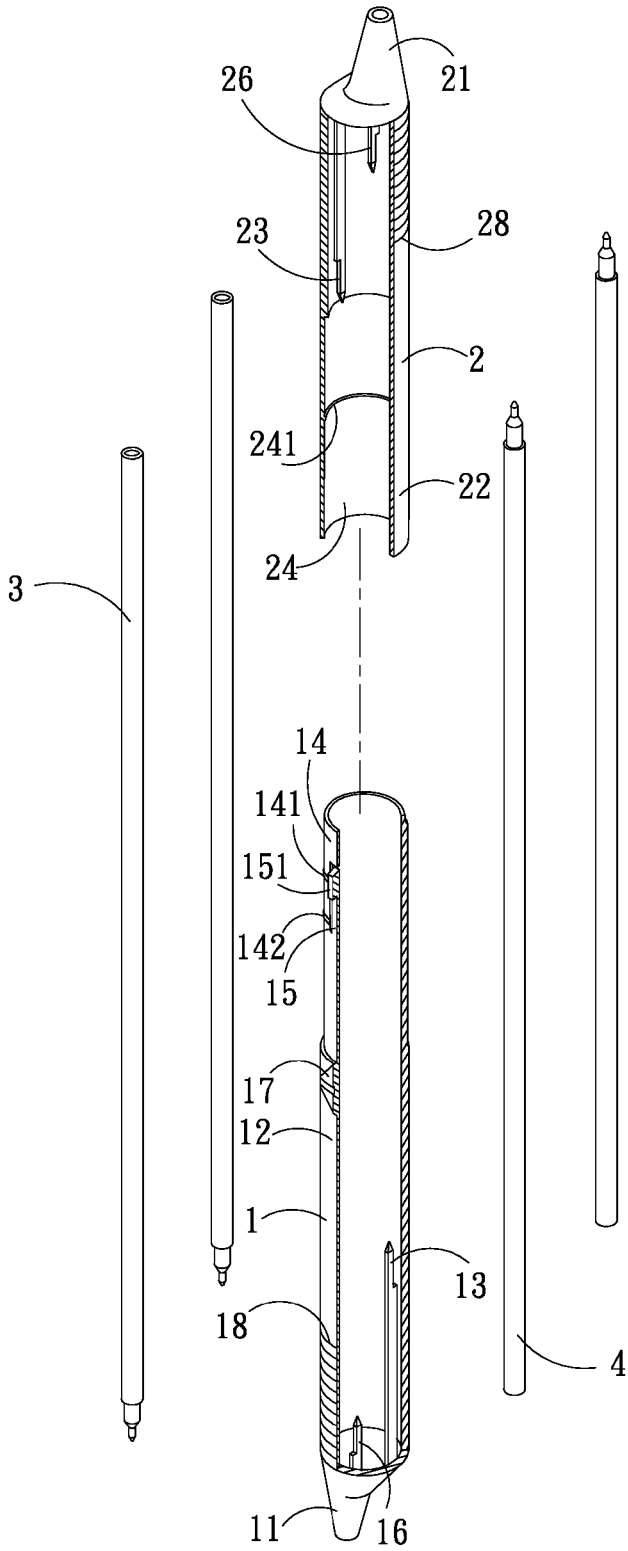
FIG. 1 is a perspective cross-sectional view of the present invention.
Figure 2:
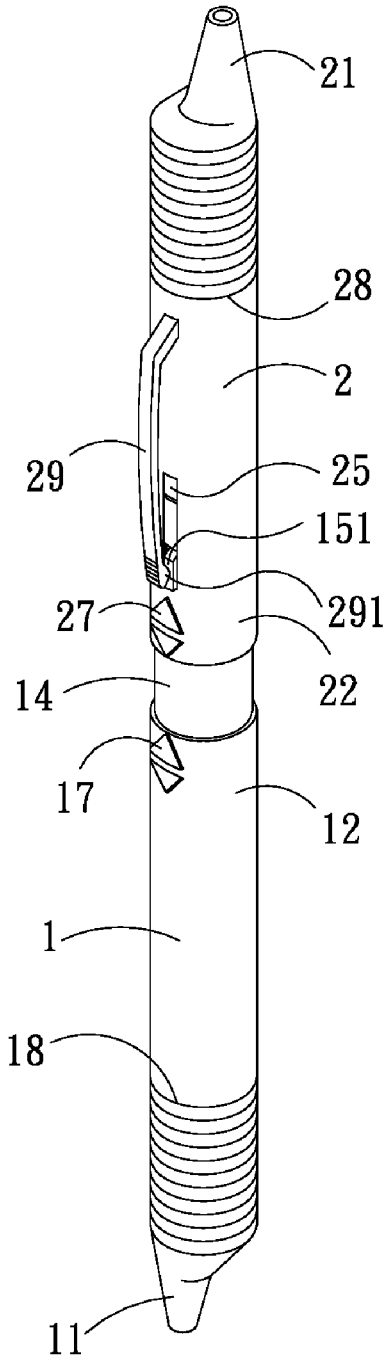
FIG. 2 is a perspective drawing of the retraction of dual cartridges of the present invention.
Figure 3:
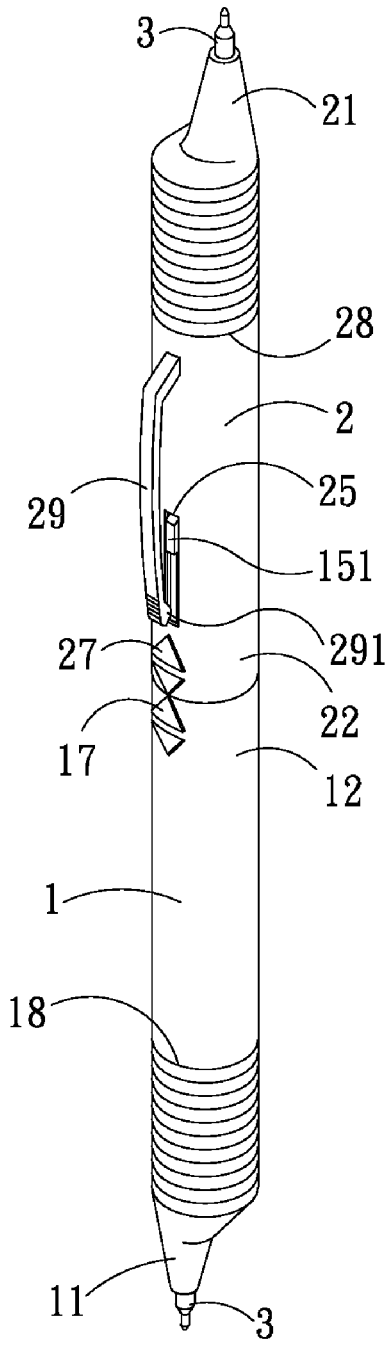
FIG. 3 is a perspective drawing of the extension of dual cartridges of the present invention.
Figure 4:
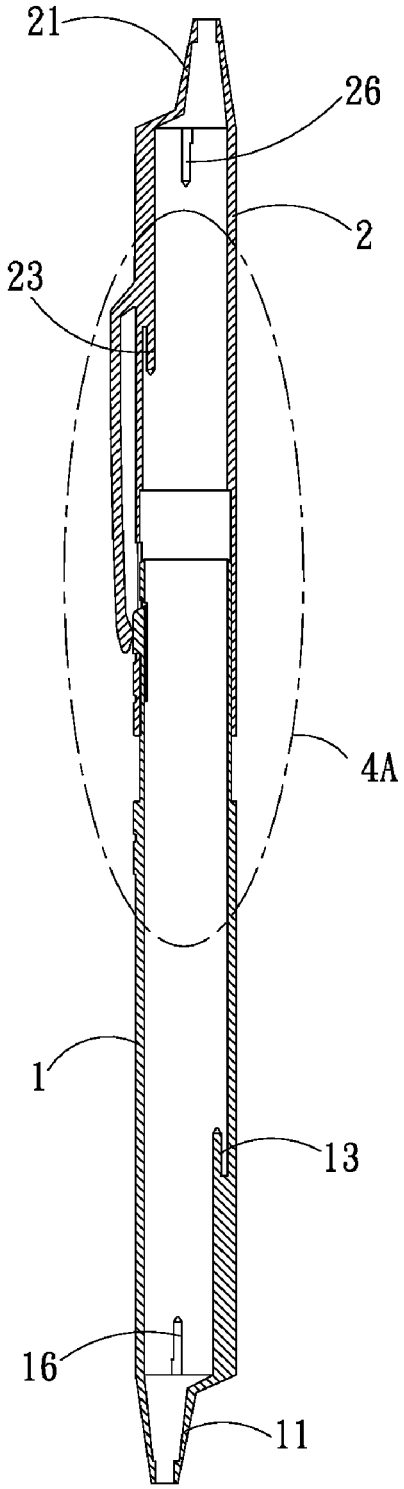
FIG. 4 is a cross-sectional view of the extension structure example of pen tube of the present invention.
Figure 5:
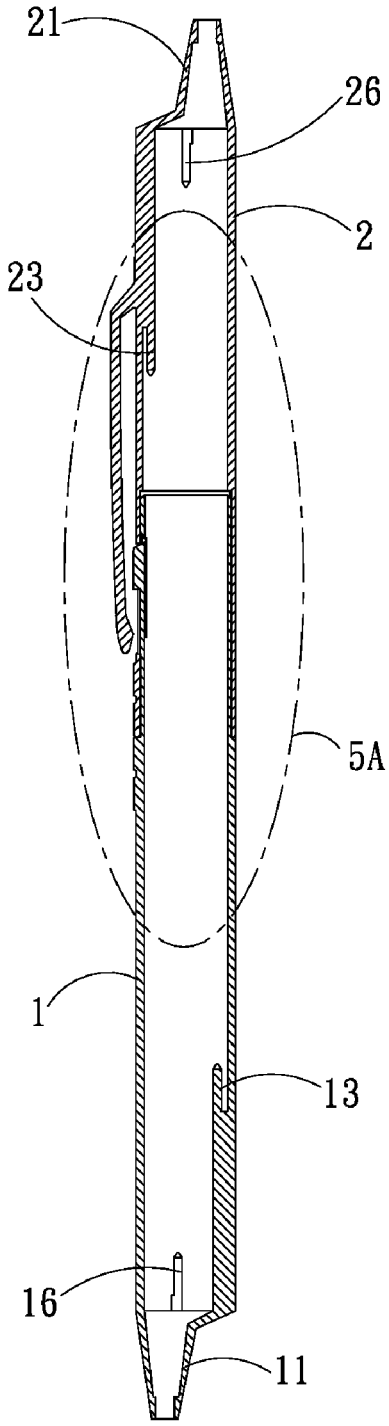
FIG. 5 is a cross-sectional view of the close structure example of pen tube of the present invention.
Figure 4A:
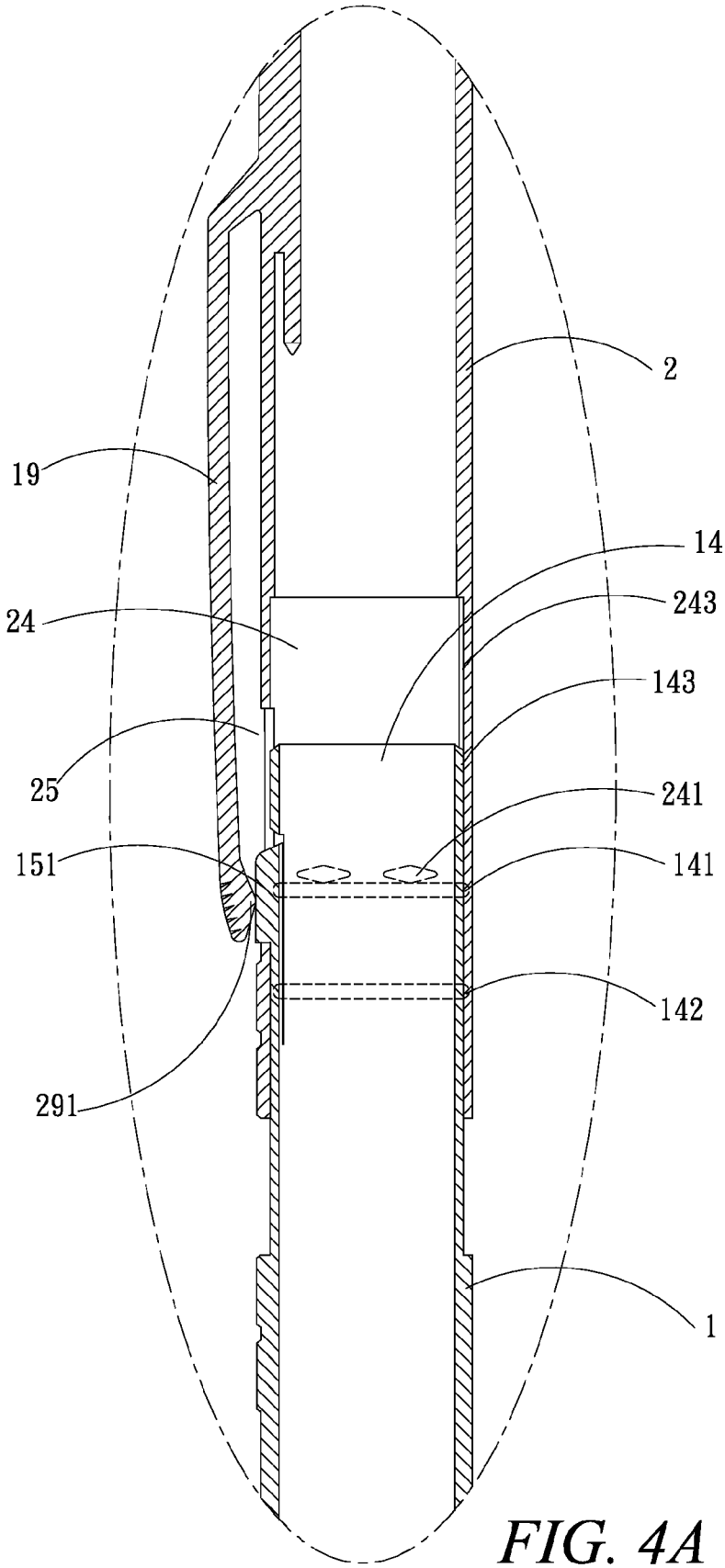
FIG. 4A is a detail drawing of the fastening structure of FIG. 4.
Figure 5A:
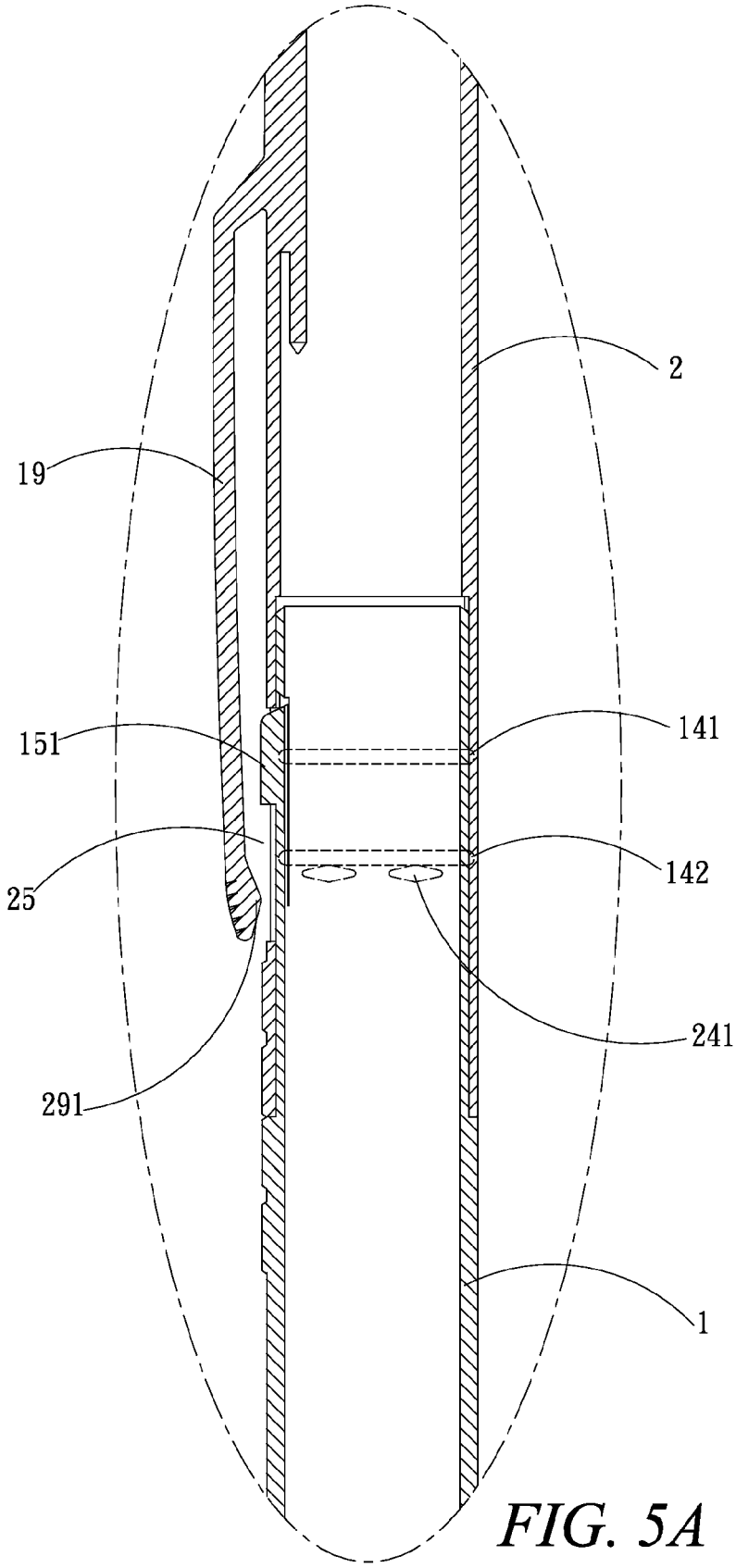
FIG. 5A is a detail drawing of the fastening structure of FIG. 5.
Figure 6:
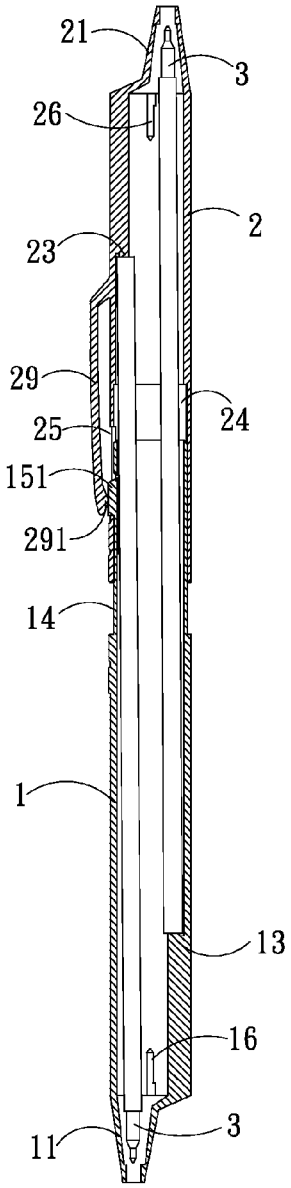
FIG. 6 is a lateral cross-sectional view of the retraction of dual cartridges of the present invention.
Figure 7:
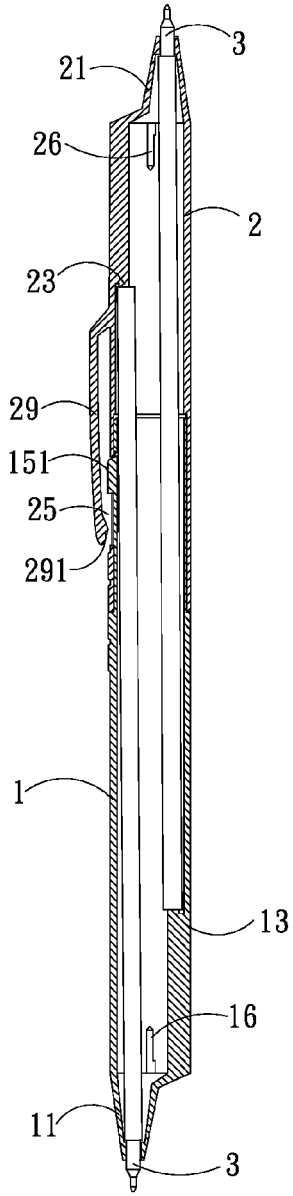
FIG. 7 is a lateral cross-sectional view of the extension of dual cartridges of the present invention.
Figure 8:
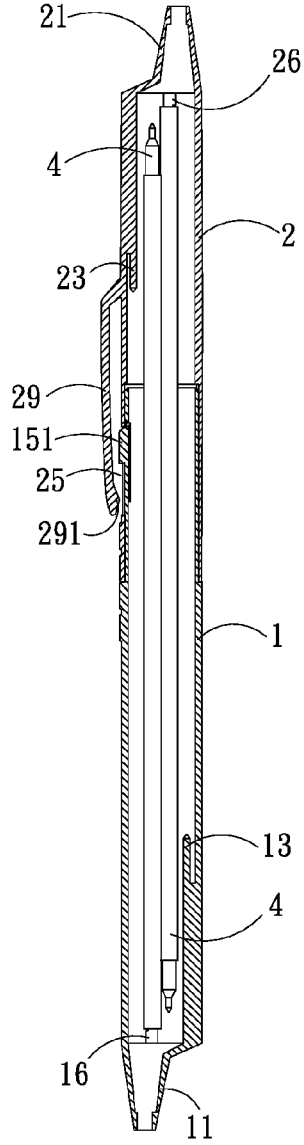
FIG. 8 is a lateral cross-sectional view of the installation example of spare cartridge of the present invention.
Figure 9:
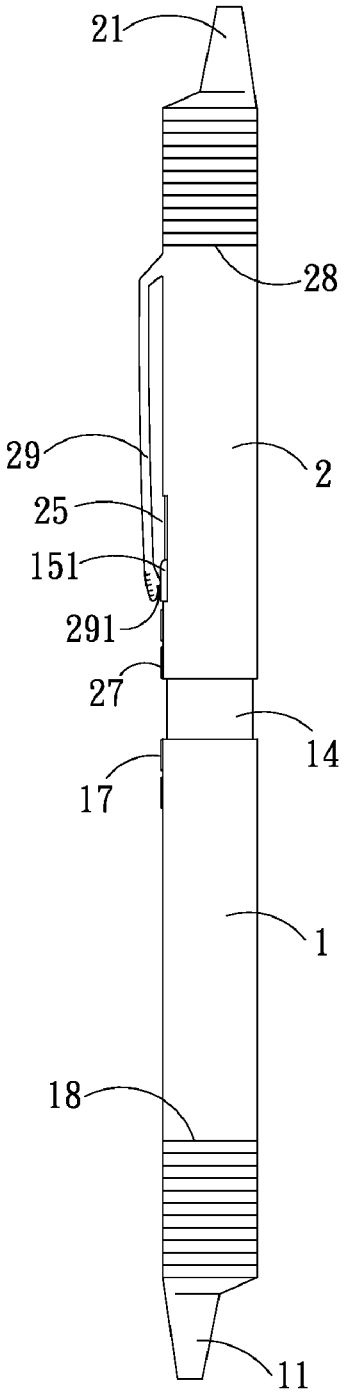
FIG. 9 is a lateral outer appearance drawing of the retraction of dual cartridges of the present invention.
Figure 10:
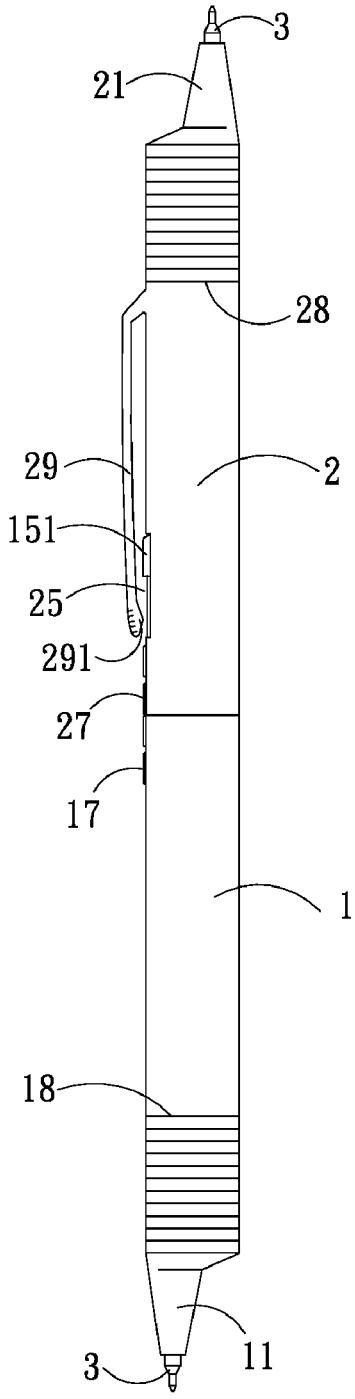
FIG. 10 is a lateral outer appearance drawing of the extension of dual cartridges of the present invention.

Referring to FIG. 1~FIG. 15, the present invention provides a pen with dual extension/retraction cartridges, which mainly comprises two pen tubes 1, 2. The first pen tube 1 has a pen tip portion 11, a pen end portion 12, a writing insertion plate 13 disposed inside the tube near the pen tip portion 11, a guiding tube 14 disposed at the pen end portion 12, an elastic plate 15 disposed at one side of the guiding tube 14, a positioning fastener 151 disposed at one side of the elastic plate 15, a front positioning ring 141 and a rear positioning ring 142 disposed around the peripheral of the guiding tube 14. The second pen tube 2 has a pen tip portion 21, a pen end portion 22, a writing insertion plate 23 disposed inside the tube near the pen tip portion 21 of the second pen tube 2, a guiding slot 24 disposed at the pen end portion 22, a positioning hole 25 passing through at one side of the guiding slot 24 and a fastener 241 disposed around the peripheral of the guiding slot 24 so that the guiding tube 14 of the first pen tube 1 is inserted into the guiding slot 24 and the positioning fastener 151 is engaged with the positioning hole 25 via the elastic plate 15 and the fastener 241 is engaged with the front positioning ring 141 and rear positioning ring 142. The abovementioned writing insertion plates 13,23 of the first pen tube 1 and second pen tube 2 are inserted with a cartridge respectively to form a pen with dual extension cartridges.

After the abovementioned first pen tube 1 and second tube 2 are inserted with cartridges, the first pen tube 1 is inserted into the guiding slot 24 via the guiding tube 14 and the front end of the positioning fastener 151 of the first pen tube 1 is disposed with a slope surface 152 (FIGS. 11C, 11D) so that the positioning fastener 151 is slid into the guiding slot 24 smoothly and protruded from the positioning hole 25. At this moment the two cartridges 3 are hidden inside the two pen tubes 1, 2. Through the positioning fastener 151 is engaged with the periphery of the positioning hole 25 and the fastener 241 is against the exterior of the front positioning ring 141 to stabilize the corresponding open position of the first pen tube 1 and the second pen tube 2. Thus it needs only a little force to make the fastener 241 cross the front positioning ring 141 so that the first pen tube 1 and second pen tube 2 approach each other to close and the fastener 241 is engaged with the rear positioning ring 142 to fix. At this moment the two cartridges 3 are exposed from the first pen tube 1 and the second pen tube 2 for writing.

Accordingly, as shown in FIG. 4A, FIG. 4B, FIGS. 11~15, generally the first pen tube 1 and the second pen tube 2 of the present invention are in the form of extension by means of the positioning fastener 151 being engaged with the peripheral of the positioning hole 25 to prevent the first pen tube 1 and second pen tube 2 from coming off by chance. And through the fastener 241 is against the exterior of the front positioning ring 141 so that the first pen tube 1 and second pen tube 2 do not approach each other and maintain stabilization. When in writing the contact surface of the first pen tube 1 and the second pen tube 2 provides support and the fastener 241 is engaged with the rear positioning ring 142 to prevent the first pen tube 1 and the second pen tube 2 from coming off by change to maintain stability for writing.

In addition to the cartridge 3, spare insertion plates 16, 26 are disposed beside the writing insertion plates 13, 23 of the first pen tube 1 and second pen tube 2. The spare insertion plates 16, 26 are shorter than the writing insertion plates 13, 23 and a spare cartridge 4 is inserted on the spare insertion plates 16, 26 so that the spare cartridge is often kept hidden inside the first pen tube 1 and second pen tube 2. Accordingly, a user does not feel the existence of the spare cartridge when he manipulates the pen. Only when it is difficult in writing for original cartridge 3 it is needed to open the first pen tube 1 and the second pen tube 2 to replace spare cartridge 4. Additionally, in consideration of air pressure the abovementioned writing insertion plates 13, 23 and spare insertion plates 16, 26 are in the form of a sheet and forms an air opening between the insertion holes of cartridge 3 and spare cartridge 4 so that the ink inside the cartridge 3 and the spare cartridge 4 flows out smoothly. Furthermore, the spare cartridge 4 is used to fill the remaining space inside the first pen tube 1 and the second pen tube 2 without particularly enlarging the diameter of the first pen tube 1 and second pen tube 2. Also while in writing the spare cartridge 4 provides support for the writing cartridge 3 so that the writing becomes more convenient. The positioning hole 25 has to be shifted in the disposition of the abovementioned cartridge 3, spare cartridge 4 to avoid hindering the movement of the positioning fastener 151.

Furthermore, to prevent the two cartridges from compressing each other inside the two pen tubes. The pen tip portions 11, 21 of the first pen tube 1 and the second pen tube 2 are shifted from each other by a distance and the two writing insertion plates 13, 23 are disposed correspondingly near the pen tip portions 11, 21 so that the two cartridges 3 are maintained a distance from each other and maintained as straight as possible when the first pen tube 1 and the second pen tube 2 are extended/retracted. At the same time, the spare insertion plates 16, 26 and the writing insertion plates 13, 23 are shifted by a distance to keep the writing cartridge 3 and the spare cartridge 4 from interfering.

The pen tip portion 11, pen end portion 12, writing insertion plate 13, guiding tube 14, front positioning ring 141, rear positioning ring 142, elastic plate 15, positioning fastener 151 of abovementioned first pen tube 1 are all made in one piece. Similarly the pen tip portion 21, pen end portion 22, writing insertion plate 23, guiding slot 24, fastener 241, positioning hole 25 of the second pen tube 2 are all made in one piece. Therefore, the present invention merely has two key members and cooperates with the existing cartridge structure 3 to constitute a pen with dual extension cartridges of the present invention.

Furthermore, the exterior of the abovementioned second pen tube 2 is disposed with a pen clip 29. In addition to the inherent hook function the pen clip 29 is formed with a fastening point 291 at the end which points the lower rim of the positioning hole 25. By means of such a structure when it is required to open the first pen tube 1 and second pen tube 2 the positioning fastener 151 is pushed out of the rear positioning hole 25 by the fastening point 291 through the force of the pen clip 29 to facilitate the detachment of the first pen tube 1 and second pen tube 2.

Figures 11, 11A, 11B, 11C, 11D:
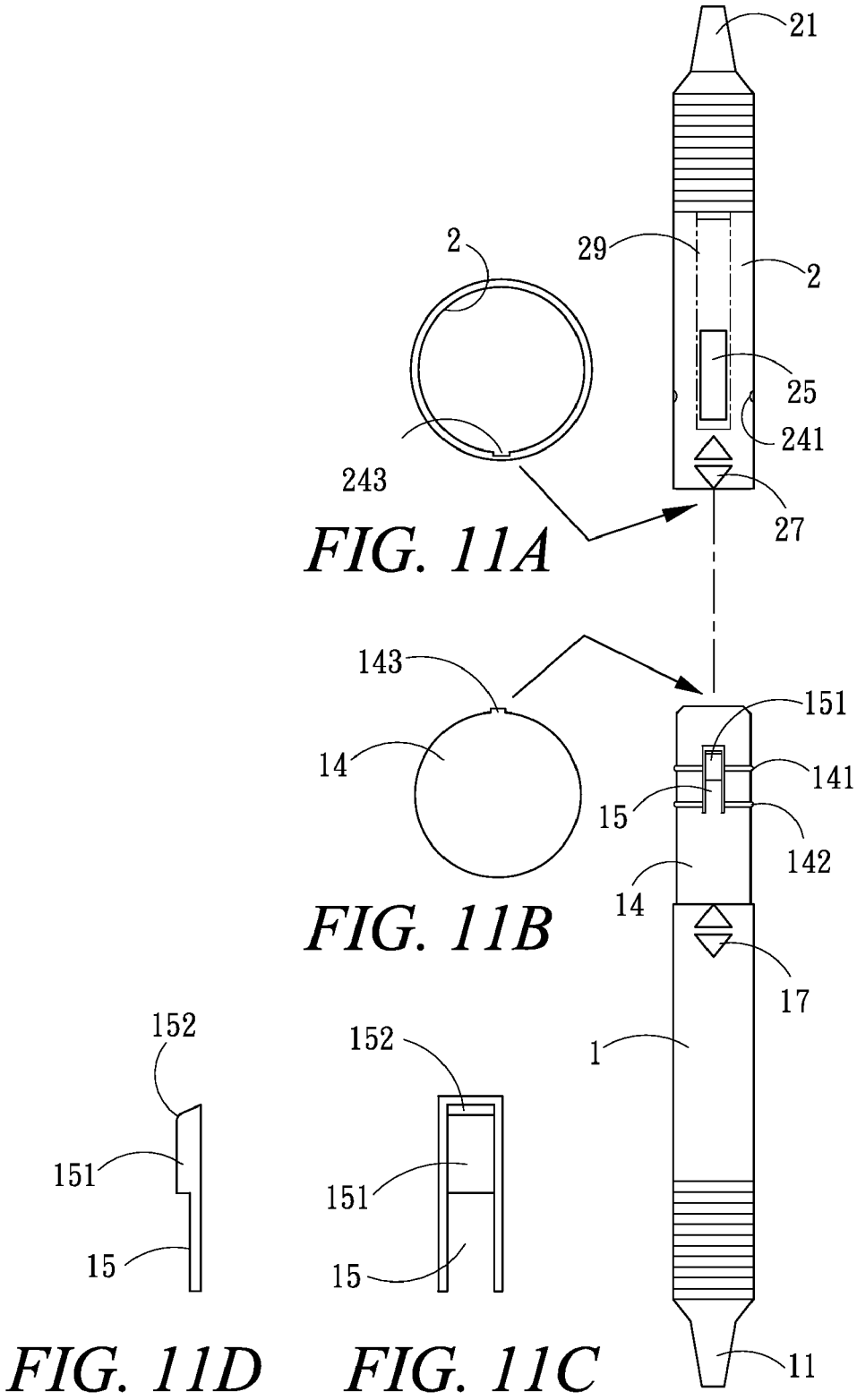
FIG. 11 is a front structure drawing of the detachment of pen tube of the present invention.
FIG. 11A is a plane structure drawing of the opening of first pen tube of the present invention.
FIG. 11B is a plane structure drawing of the opening of second pen tube of the present invention.
FIG. 11C is a front view of the elastic plate structure of the present invention.
FIG. 11D is a lateral view of the elastic plate structure of the present invention.
Figure 12:
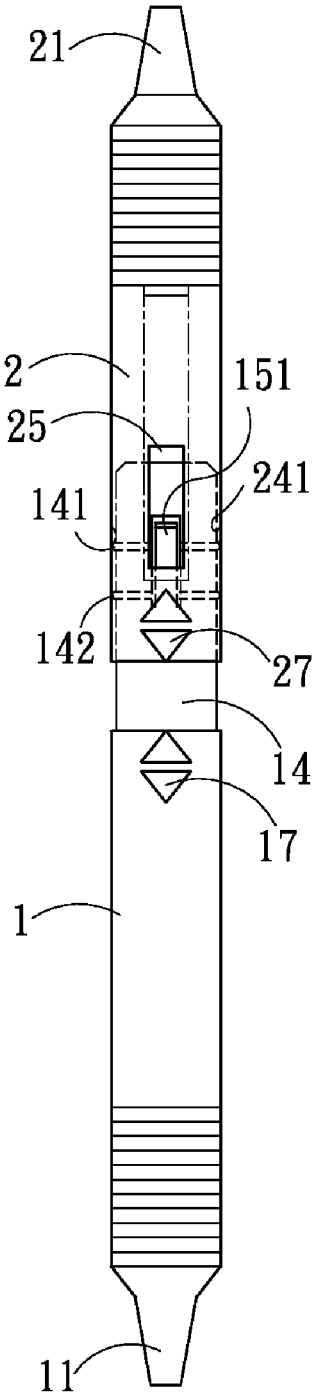
FIG. 12 is a front outer appearance drawing with hidden lines when the dual cartridges of the present invention are retracted.
Figure 13:
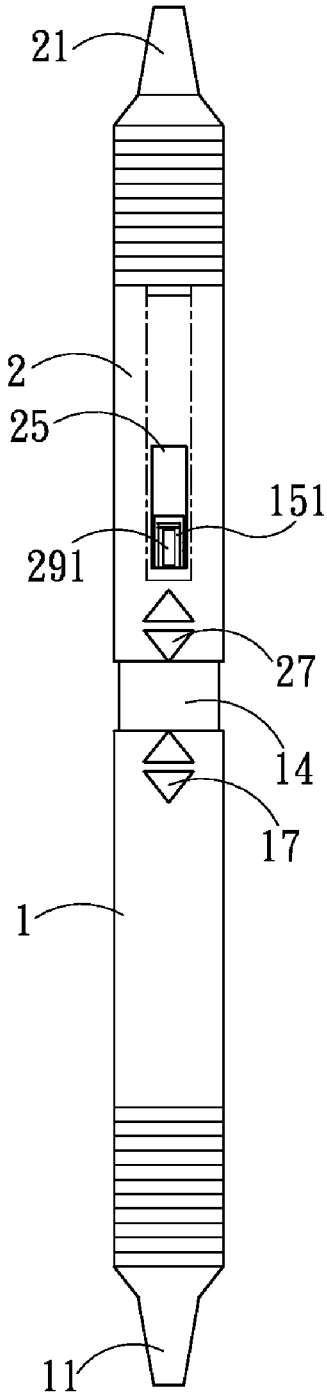
FIG. 13 is a front outer appearance drawing without hidden lines when the dual cartridges of the present invention are retracted.
Figure 14:
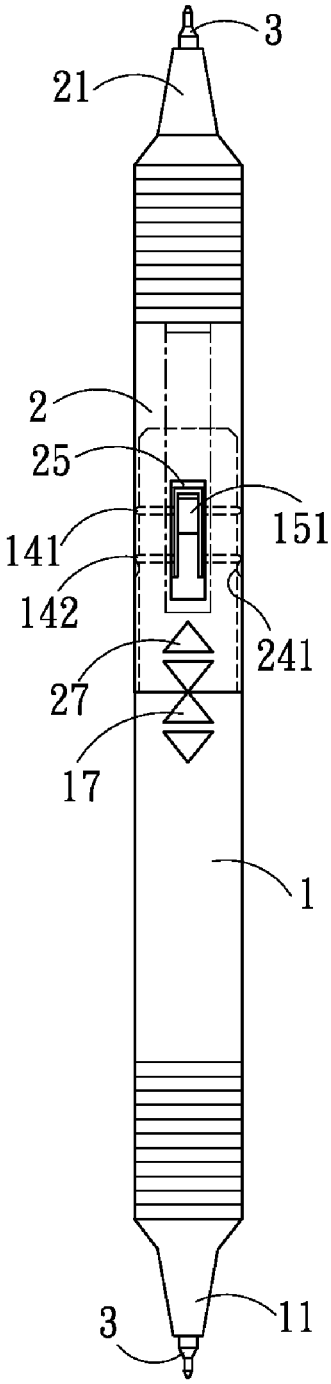
FIG. 14 is a front outer appearance drawing with hidden lines when the dual cartridges of the present invention are extended.
Figure 15:
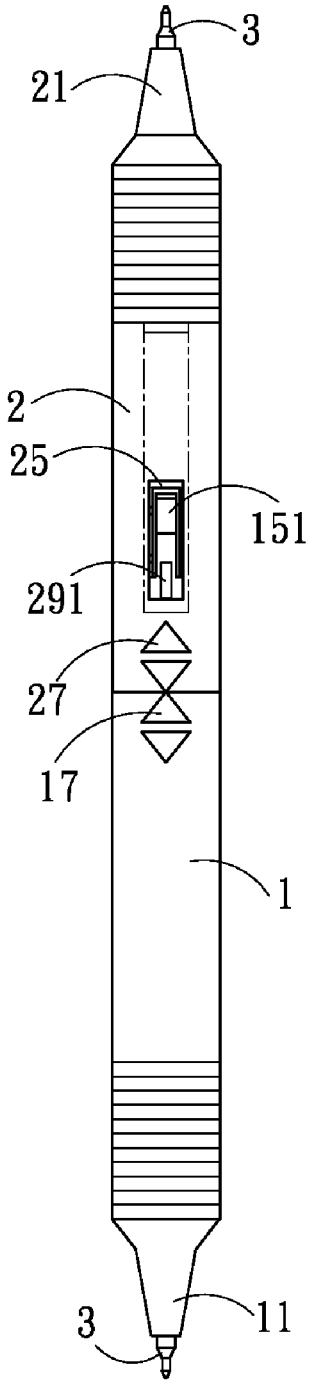
FIG. 15 is a front outer appearance drawing without hidden lines when the dual cartridges of the present invention are extended.
Figure 16:
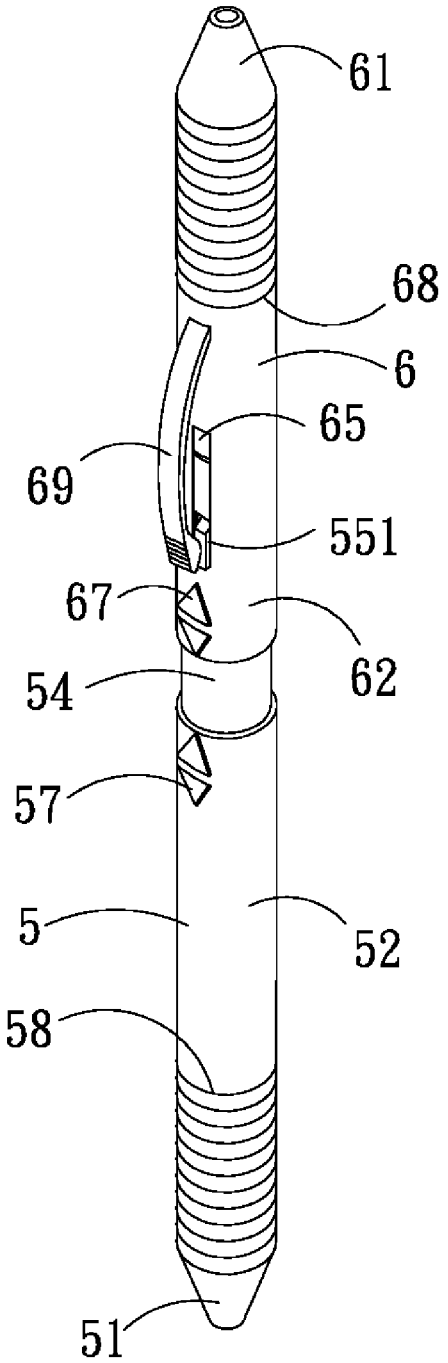
FIG. 16 is a perspective drawing of the retraction of dual cartridges of the second embodiment.
Figure 17:
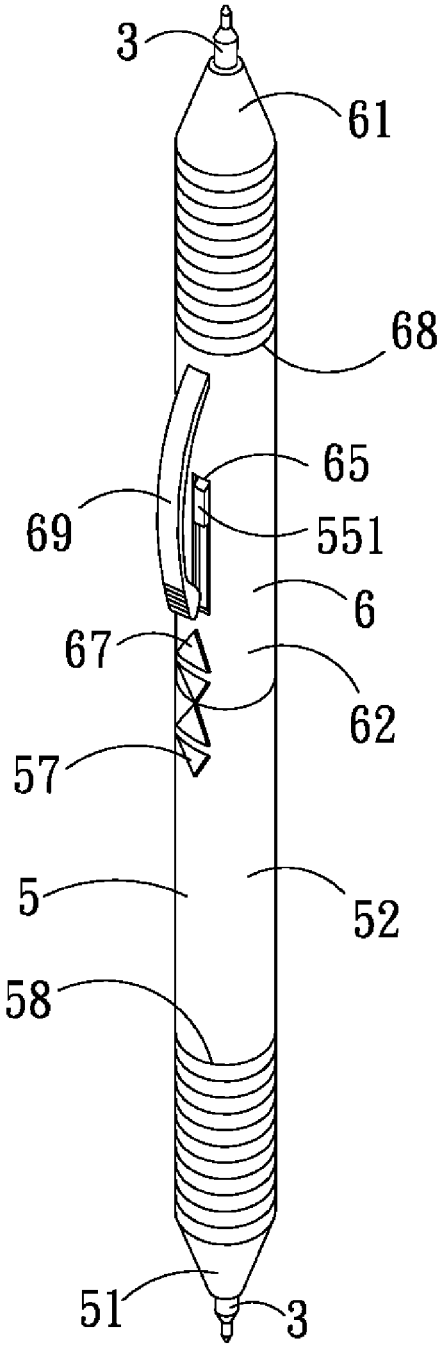
FIG. 17 is a perspective drawing of the extension of dual cartridges of the second embodiment.
Figure 18:
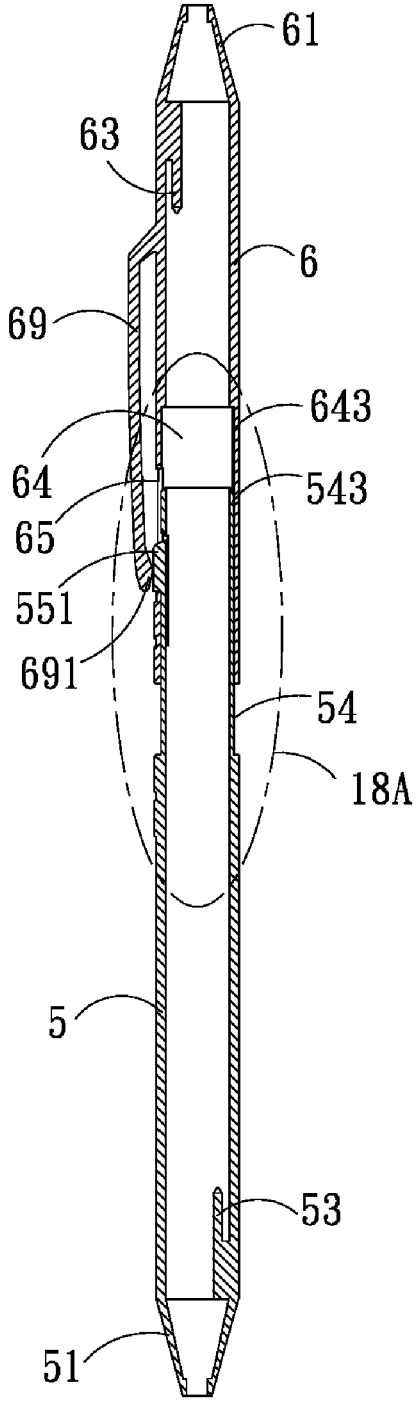
FIG. 18 is a cross-sectional view of the extension structure of pen tube example of the second embodiment.
Figure 19:
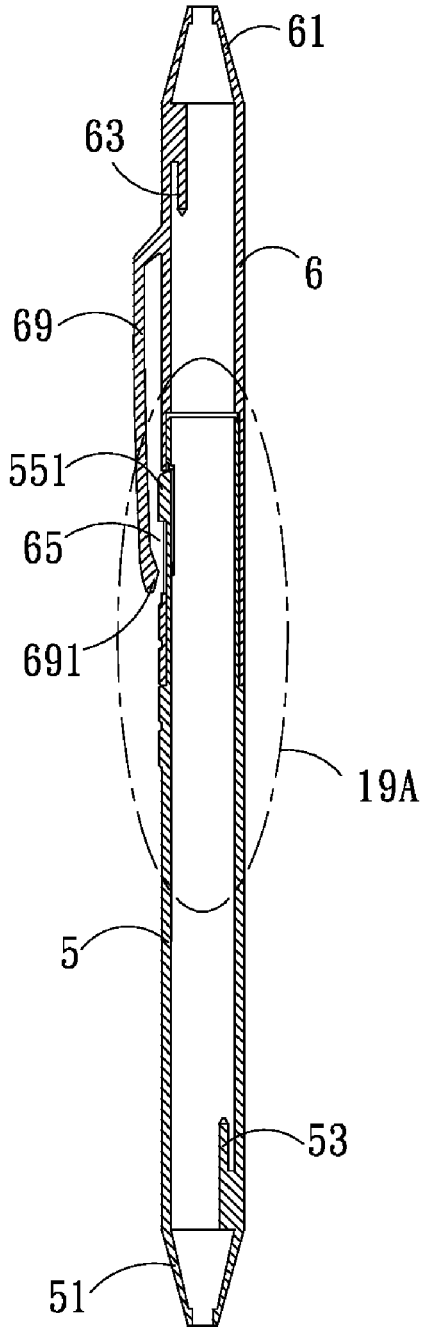
FIG. 19 is a cross-sectional view of the close structure of pen tube example of the second embodiment.
Figure 18A:
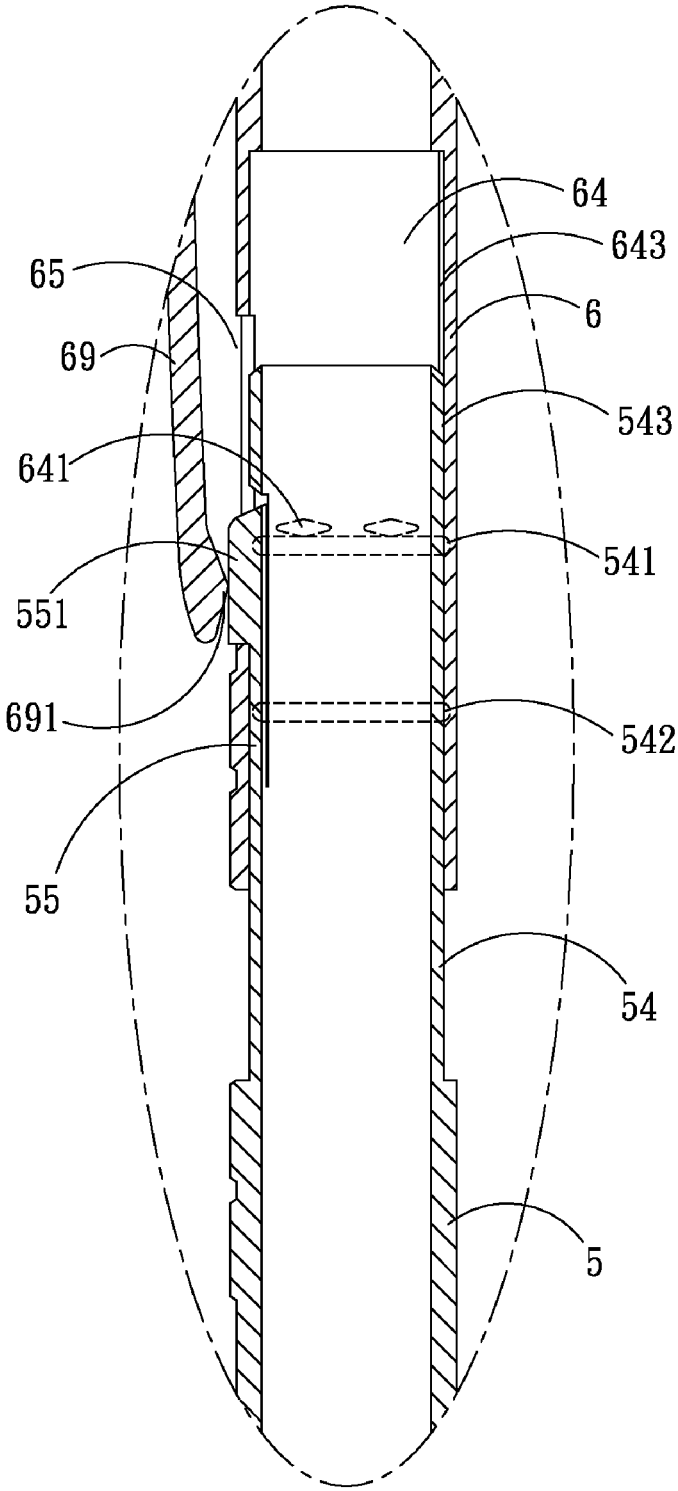
FIG. 18A is a detail drawing of the fastening structure of FIG. 18.
Figure 19A:
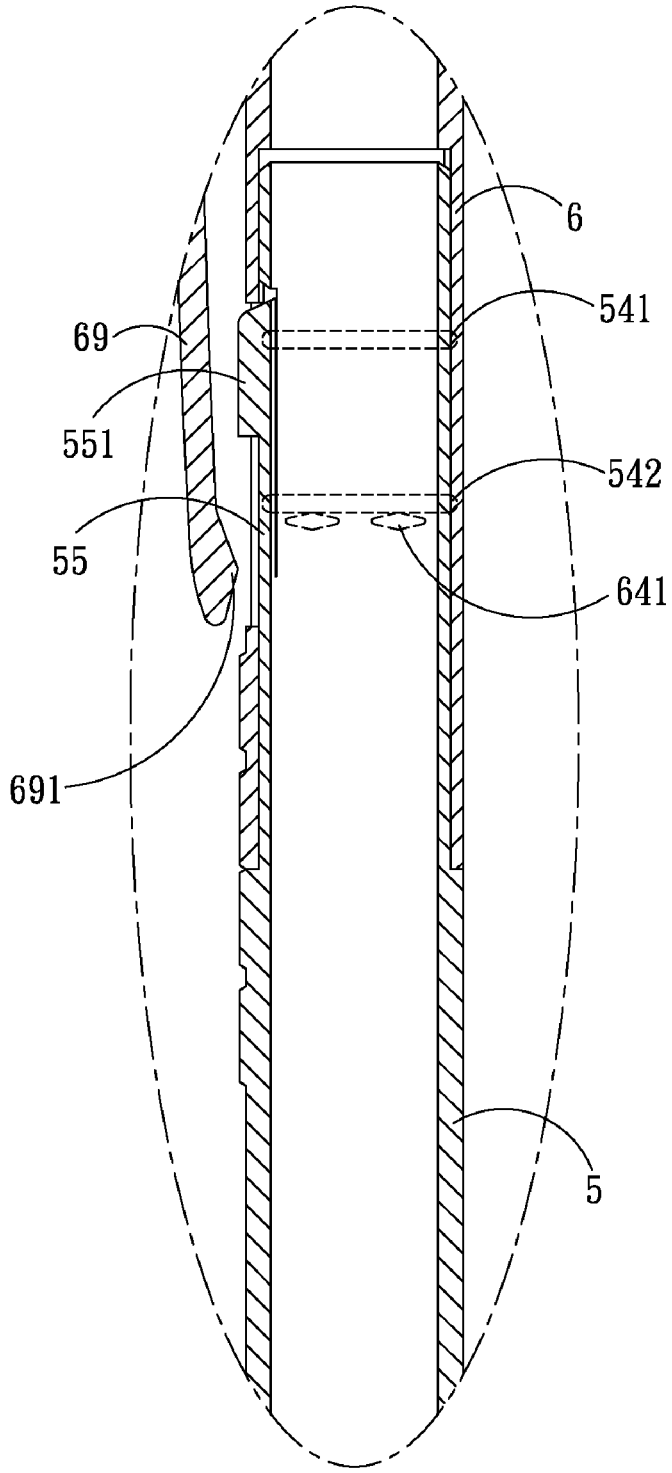
FIG. 19A is a detail drawing of the fastening structure of FIG. 19.
Figure 20:
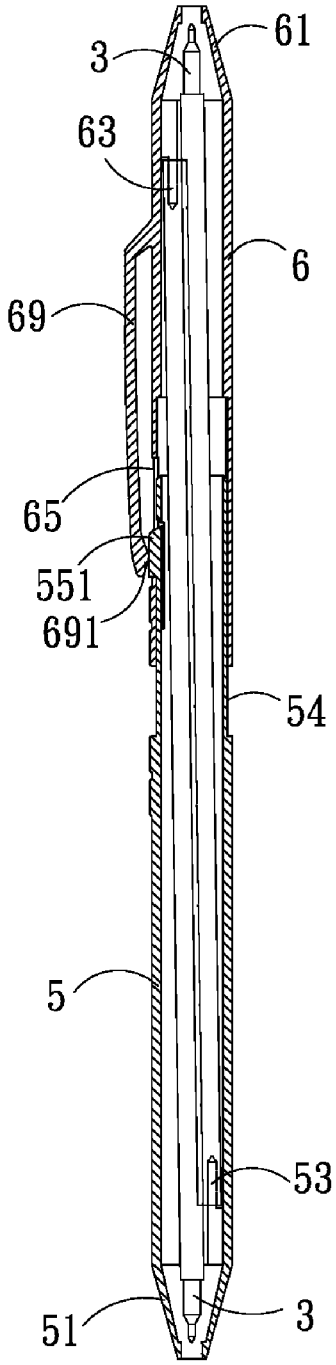
FIG. 20 is a lateral cross-sectional view of the extension of dual cartridges of the second embodiment.
Figure 21:
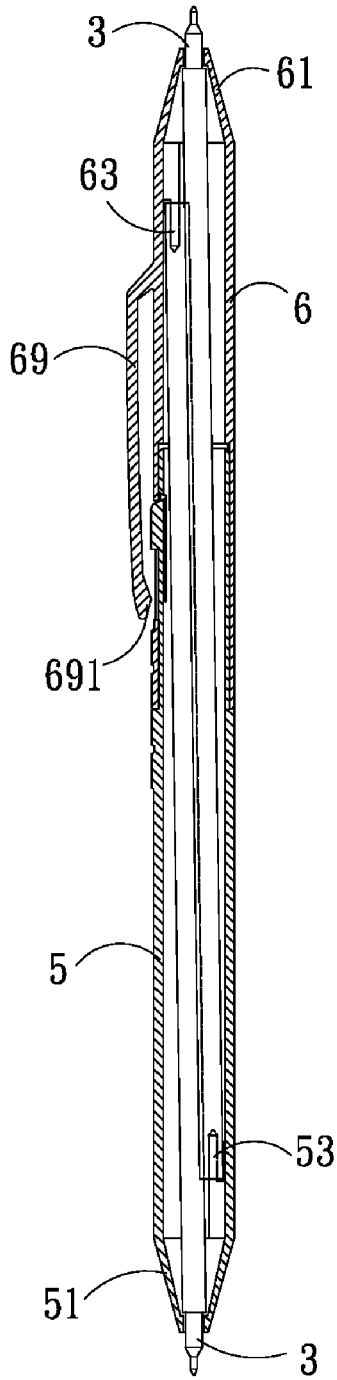
FIG. 21 is a lateral cross-sectional view of the disposition example of spare cartridge of the second embodiment.
Figure 22:
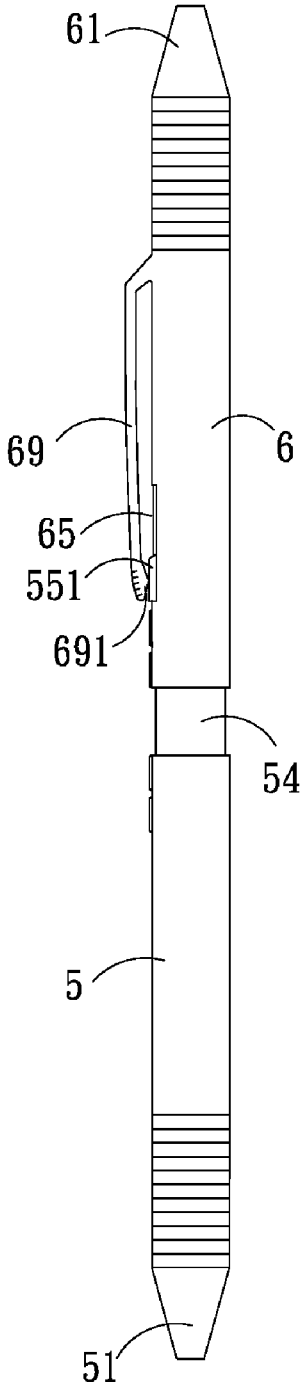
FIG. 22 is a lateral outer appearance drawing of the retraction of dual cartridges of the second embodiment.
Figure 23:
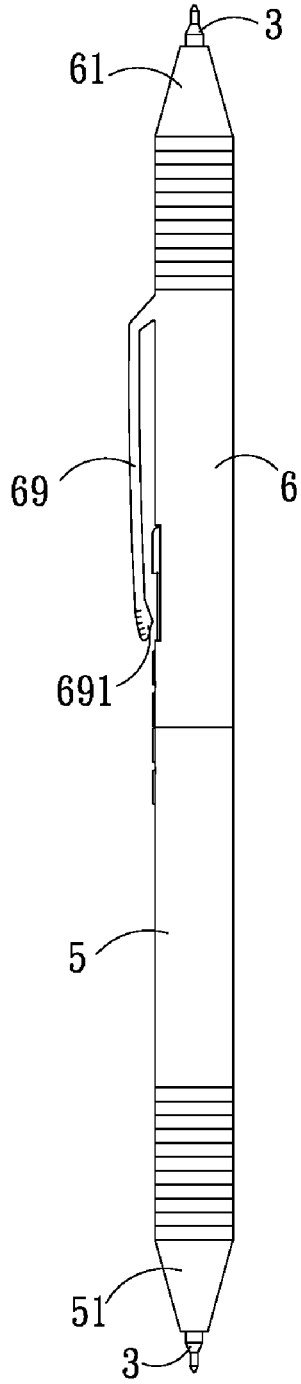
FIG. 23 is a lateral outer appearance drawing of the extension of dual cartridges of the second embodiment.

Furthermore, as shown in FIG. 11A, FIG. 11B, the guiding tube 14 of the abovementioned first pen tube 1 is disposed with a guiding rail 143 and a guiding groove 243 inside the guiding slot 24 of the second pen tube 2 correspondingly so that the guiding rail 143 is positioned with the corresponding locations of the first pen tube 1 and the second pen tube 2 through the guiding groove 243. There are indicators 17, 27 formed in cooperation with the surface of first pen tube 1 and second pen tube 2 and disposed correspondingly to facilitate the positioning and manipulation for user.

The surfaces of front end of abovementioned two tubes 1, 2 are disposed with stripe like holding surfaces 18, 28 to increase the friction force for holding by user.

Referring to FIGS. 16~23 they show another embodiment of the present invention which likewise comprises a first pen tube 5 and a second pen tube 6 and a pen tip portion 51, pen end portion 52, writing insertion plate 53, guiding tube 54, front positioning ring 541, rear positioning ring 542, guiding rail 543, elastic plate 55, positioning fastener 551, indicator 57, holding surface 58 of the first pen tube 5 which are all made in one piece and a pen tip portion 61, pen end portion 62, writing insertion plate 63, guiding slot 64, fastener 641, guiding groove 643, positioning hole 65, indicator 67, holding surface 68, clip 69 of the second pen tube 6 which are all made in one piece. Between the two embodiments the biggest variation is the pen tip portions 51, 61 of the first pen tube 5 and the second pen tube 6 do not have the design of biasing and the same with a conventional pen, and the writing insertion plates 53, 63 inside the first pen tube 5 and the second tube 6 are disposed freely provided that the two cartridges are biased a proper distance from each other. Additionally, in the present embodiment there is no disposition of a spare cartridge 4 of the first embodiment. Therefore the first pen tube 5 and the second pen tube are more delicate and capable for use conveniently.

Figure 24:
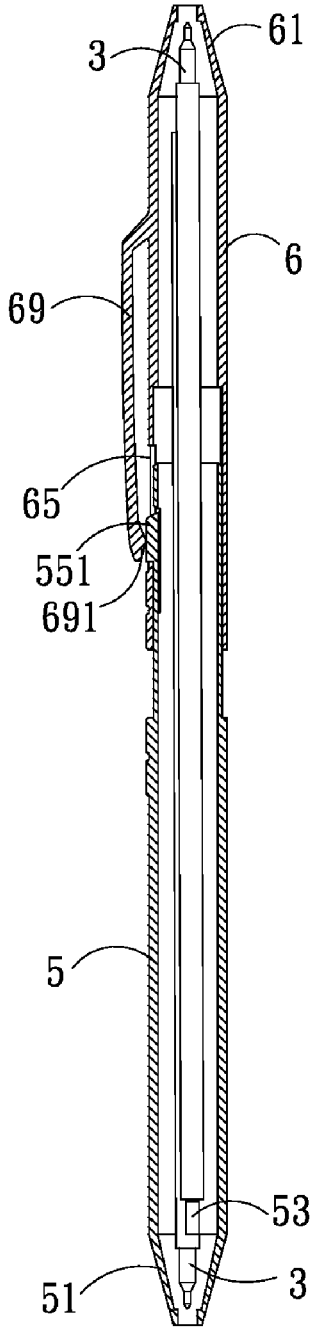
FIG. 24 is a lateral cross-sectional view of the retraction of dual cartridges of the variation of writing insertion plate of the second embodiment.
Figure 25:
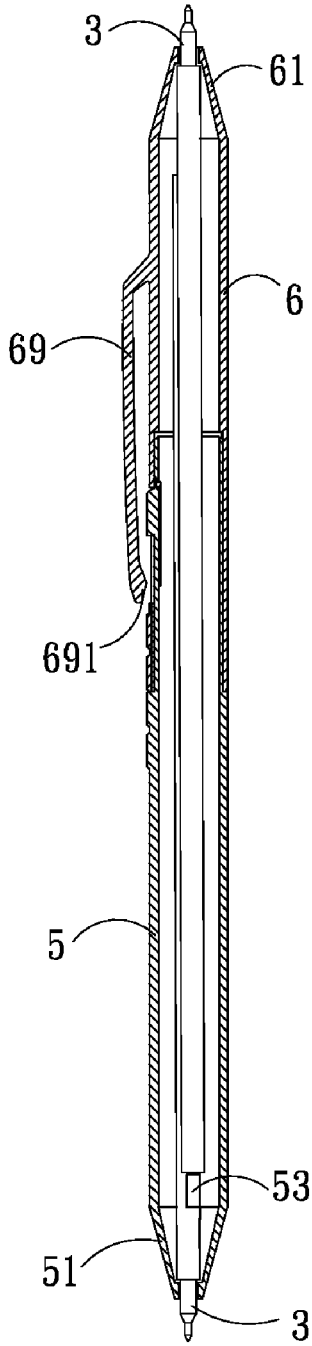
FIG. 25 is a lateral cross-sectional view of the extension of dual cartridges of the variation of writing insertion plate of the second embodiment.

Referring to FIG. 24, 25 the location of writing insertion plates 53, 63 of the first pen tube 5 and second pen tube 6 can be changed depending on the need of a user and does not affect the function of the present invention.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A pen with dual extension/retraction cartridges, comprising:

a first pen tube with a first pen tip portion and a first pen end portion, wherein the first pen tube is disposed with a first writing insertion plate inside the tube near the first pen tip portion and the first pen end portion is disposed with a guiding tube which has an elastic plate disposed at one side and two positioning rings disposed at the peripheral of the guiding tube;

a second pen tube with a second pen tip portion and a second pen end portion, wherein the second pen tube is disposed with a second writing insertion plate inside the tube near the second pen tip portion, and the second pen end portion is disposed with a guiding slot having a positioning hole passing through at one side and a fastener disposed around the peripheral of the guiding slot so that the guiding tube of the first pen tube is inserted into the guiding slot and the positioning fastener is engaged with the positioning hole via the elastic plate and the fastener is engaged with the two positioning rings;

two cartridges inserted onto the first and the second writing insertion plates of the first pen tube and the second pen tube respectively; and after the cartridges are inserted into the first and the second pen tubes, the first pen tube is inserted into the guiding slot via the guiding tube to have both pen tubes combined, then two cartridges are hidden inside the two pen tubes respectively and engaged with the peripheral of a positioning hole via the positioning fastener and the fastener is against the exterior of a front positioning ring to stabilize the positions of both pen tubes, thus a little force is exerted to have the fastener cross the front positioning ring to close the two pen tubes so that the fastener is engaged with rear positioning ring to fix, then both cartridges are exposed out of the two pen tubes for writing.

2. The pen with dual extension/retraction cartridges as claimed in claim 1, wherein the first and the second pen tip portions of the first and the second pen tubes are shifted by a distance relatively so that both cartridges are kept as straight as possible while in use.

3. The pen with dual extension/retraction cartridges as claimed in claim 1, wherein shorter spare insertion plates are disposed beside the first and the second writing insertion plates of the first and the second pen tubes and spare cartridges are engaged with the spare insertion plate so that the spare cartridges are often kept inside the two pen tubes.

4. The pen with dual extension/retraction cartridges as claimed in claim 1, wherein the pen tip portion, pen end portion, writing insertion plate, guiding tube, elastic plate, positioning fastener, positioning ring of the first pen tube are all made in one piece.

5. The pen with dual extension/retraction cartridges as claimed in claim 1, wherein the pen tip portion, pen end portion, writing insertion plate, guiding slot, positioning hole, fastener of the second pen tube are all made in one piece.

6. The pen with dual extension/retraction cartridges as claimed in claim 1, wherein the front end of the positioning fastener of the first pen tube is disposed with a slope surface so that the positioning fastener slides into the guiding slot and the positioning hole smoothly when the two pen tubes are combined.

7. The pen with dual extension/retraction cartridges as claimed in claim 1, wherein the guiding tube of the first pen tube is disposed with a guiding rail and a guiding groove inside the guiding slot of the second pen tube correspondingly to position the relative location of the two pen tubes via the guiding groove.

8. The pen with dual extension/retraction cartridges as claimed in claim 1, wherein the surfaces of the two tubes are formed with indicators and have the indicators of the two pen tubes disposed correspondingly to facilitate the positioning and manipulation for user.

9. The pen with dual extension/retraction cartridges as claimed in claim 1, wherein the exterior of the second pen tube is disposed with a pen clip having s fastener point formed at the end and the positioning fastener is pushed by the fastening point to get out of the positioning hole via the force exerted by the pen clip to detach the two pen tubes.

* * * * *